US011828477B2

(12) United States Patent
Nagano et al.

(10) Patent No.: US 11,828,477 B2
(45) Date of Patent: Nov. 28, 2023

(54) HEAT EXCHANGER AND AIR CONDITIONER

(71) Applicant: Daikin Industries, LTD., Osaka (JP)

(72) Inventors: Tomohiro Nagano, Osaka (JP); Hirokazu Fujino, Osaka (JP); Kaori Yoshida, Osaka (JP); Isao Fujinami, Osaka (JP); Deb Kumar Mondal, Osaka (JP); Hiroki Yamaguchi, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 62 days.

(21) Appl. No.: 16/494,360

(22) PCT Filed: Mar. 30, 2018

(86) PCT No.: PCT/JP2018/014015
§ 371 (c)(1),
(2) Date: Sep. 16, 2019

(87) PCT Pub. No.: WO2018/182036
PCT Pub. Date: Oct. 4, 2018

(65) Prior Publication Data

US 2020/0088432 A1 Mar. 19, 2020

(30) Foreign Application Priority Data

Mar. 31, 2017 (JP) ..... 2017-072637

(51) Int. Cl.
*F24F 11/43* (2018.01)
*F28D 1/047* (2006.01)
(Continued)

(52) U.S. Cl.
CPC ..... *F24F 11/43* (2018.01); *F24F 1/48* (2013.01); *F25B 39/02* (2013.01); *F25B 47/02* (2013.01);
(Continued)

(58) Field of Classification Search
CPC .... F24F 11/43; F24F 1/48; F24F 11/41; F25B 39/02; F25B 47/02; F28D 1/047;
(Continued)

(56) References Cited

U.S. PATENT DOCUMENTS 4,179,911 A * 12/1979 Saier ..... B21C 37/207 165/184
6,119,770 A * 9/2000 Jaber ..... F28F 13/187 165/181
(Continued)

FOREIGN PATENT DOCUMENTS

EP 2813793 A1 12/2014
EP 2829835 A1 1/2015
(Continued)

OTHER PUBLICATIONS

International Preliminary Report on Patentability issued in corresponding International Application No. PCT/ JP2018/014015, dated Oct. 1, 2019, with translation (8 pages).
(Continued)

*Primary Examiner* — Len Tran
*Assistant Examiner* — Kirstin U Oswald
(74) *Attorney, Agent, or Firm* — Osha Bergman Watanabe & Burton LLP

(57) ABSTRACT

A heat exchanger includes: a surface with a water-repellent coating. The surface has a surface structure that includes protrusions. Condensed water droplets, each having a droplet diameter that allows a subcooled state to be maintained even under a predetermined freezing condition, combine
(Continued)

with one other on the surface and generate an energy. The surface structure uses the energy to remove the combined condensed water droplets from the surface.

10 Claims, 11 Drawing Sheets

(51) Int. Cl.

| | |
|---|---|
| ***F28F 13/18*** | (2006.01) |
| ***F28F 17/00*** | (2006.01) |
| ***F28F 19/02*** | (2006.01) |
| ***F24F 1/48*** | (2011.01) |
| ***F25B 39/02*** | (2006.01) |
| ***F25B 47/02*** | (2006.01) |
| *F28D 21/00* | (2006.01) |

(52) U.S. Cl.
CPC ..... *F28D 1/047* (2013.01); *F28F 13/187* (2013.01); *F28F 17/005* (2013.01); *F28F 19/02* (2013.01); *F28D 2021/0068* (2013.01); *F28F 2245/04* (2013.01)

(58) Field of Classification Search
CPC ..... F28D 2021/0068; F28F 13/187; F28F 17/005; F28F 19/02; F28F 2245/04
USPC ..... 62/154
See application file for complete search history.

(56) References Cited

U.S. PATENT DOCUMENTS

| | | | | |
|---|---|---|---|---|
| 6,764,745 | B1 * | 7/2004 | Karasawa | B32B 9/005 428/338 |
| 2004/0035561 | A1 * | 2/2004 | Ko | F28D 1/0477 165/151 |
| 2005/0208268 | A1 * | 9/2005 | Extrand | F15D 1/065 428/141 |
| 2006/0283581 | A1 * | 12/2006 | Lee | F28F 17/005 165/152 |
| 2007/0031639 | A1 * | 2/2007 | Hsu | C23C 8/24 428/141 |
| 2010/0282680 | A1 * | 11/2010 | Su | B01D 67/0088 210/500.21 |
| 2012/0125030 | A1 * | 5/2012 | Kim | F28F 13/182 62/238.6 |
| 2014/0238646 | A1 * | 8/2014 | Enright | F28F 13/187 29/890.03 |
| 2017/0298314 | A1 * | 10/2017 | Lyons | B01L 3/563 |

FOREIGN PATENT DOCUMENTS

| | | | | | |
|---|---|---|---|---|---|
| JP | H 07206475 | A | * | 8/1995 | |
| JP | 2001248951 | A | | 9/2001 | |
| JP | 2011122769 | A | | 6/2011 | |
| JP | 2013092288 | A | * | 5/2013 | F28D 1/05391 |
| JP | 2013092289 | A | * | 5/2013 | F24F 1/18 |
| JP | 2013120047 | A | | 6/2013 | |
| JP | 2017-015377 | A | | 1/2017 | |
| JP | 2017115219 | A | | 6/2017 | |
| WO | WO-2006025169 | A1 | * | 3/2006 | F24F 1/18 |
| WO | WO-2011034633 | A1 | * | 3/2011 | F28D 1/05391 |
| WO | 2011/133000 | A2 | | 10/2011 | |
| WO | 2012/147288 | A1 | | 11/2012 | |

OTHER PUBLICATIONS

International Search Report issued in corresponding International Application No. PCT/JP2018/014015, dated Jun. 19, 2018, with translation (5 pages).
Notification of Transmittal of Translation of the International Preliminary Report on Patentability issued in corresponding International Application No. PCT/JP2018/014015, dated Oct. 10, 2019 (1 page).
Extended European Search Report issued in corresponding European Application No. 18776425.3 dated Mar. 12, 2020 (8 pages).

* cited by examiner

HEAT EXCHANGER AND AIR CONDITIONER

TECHNICAL FIELD

The present invention relates to a heat exchanger and an air conditioner.

BACKGROUND

A heat exchanger used as a refrigerant evaporator in an air conditioner is known.

When the heat exchanger is used in an environment in which temperature and humidity satisfies specific conditions, frost adheres to a surface of the heat exchanger. As the frost grows, the airflow resistance of the heat exchanger may increase.

If the airflow resistance of the heat exchanger increases in this way, the heat exchange efficiency of the heat exchanger decreases. Therefore, when the amount of frost increases, the airflow resistance of the heat exchanger can be reduced by performing an operation for melting the frost (defrosting operation) and the like.

However, if the defrosting operation for melting the frost is frequently performed, the main operation of the air conditioner, in which the heat exchanger functions as a refrigerant evaporator to reduce a thermal load, is hindered.

To address this, for example, according to description in PTL 1 (Japanese Unexamined Patent Application Publication No. 2013-120047), the following is proposed: the airflow direction of air that is supplied from a fan to a heat exchanger on which a water-repellent coating is formed is directed downward so that the airflow direction coincides with the direction in which gravity acts on condensed water to enable the condensed water to be easily scattered or dropped and to reduce the amount of frost in the heat exchanger.

PATENT LITERATURE

[PTL 1] Japanese Unexamined Patent Application Publication No. 2013-120047

However, in the method described in PTL 1, it is only examined that the amount of frost can be reduced by forming a water-repellent coating and specifying the airflow direction, but it is not examined at all about a surface structure of a heat exchanger for reducing the amount of frost.

SUMMARY

One or more embodiments of the present invention provide a heat exchanger and an air conditioner each of which has a surface structure that can reduce adherence of frost by scattering condensed water even when used in a frosting environment.

In one or more embodiments of the present invention it is possible to scatter condensed water and to reduce adherence of frost by using a surface structure that has water repellency and that satisfies specific conditions.

In one or more embodiments, a heat exchanger includes a portion on whose surface a water-repellent coating is formed. The surface on which the water-repellent coating is formed has a surface structure including a plurality of protrusions. The surface structure is capable of, by using energy that is generated when condensed water droplets combine with each other, removing the condensed water droplets that have combined with each other from the surface of the water-repellent coating. The condensed water droplets each have a droplet diameter that allows a subcooled state to be maintained even under a predetermined freezing condition.

Here, the predetermined freezing condition, which is not limited, may be a condition such that the ambient temperature around the condensed water is 0° C., which is the melting point of water, or lower, −1° C. or lower, −3° C. or lower, or −5° C. or lower.

Only a part of the surface on which the water-repellent coating is formed may have the surface structure, or the entirety of the surface may have the surface structure. When a part the surface has the surface structure, advantageous effects can be obtained in the part. When the entirety of the surface has the surface structure, advantageous effects can be obtained in the entirety.

The heat exchanger, which has the water-repellent coating, is not likely to hold condensed water and the like, and can easily scatter condensed water.

Even in a low-temperature environment such as an environment under the predetermined freezing condition, in a state in which the diameter of a droplet of condensed water on the surface of the water-repellent coating is sufficiently small to a degree such that a subcooled state can be maintained, freezing of the condensed water to turn into ice is suppressed, and therefore the condensed water is likely to be maintained in a liquid state.

On the surface of the water-repellent coating, when condensation water droplets that are in the subcooled state and that have very small diameter may combine with each other, energy generated when the water droplets combine with each other may not be sufficient to enable the combined water droplets to be removed from the surface of the water-repellent coating. In this case, however, because the combined condensed water still has very small diameter, the condensed water is likely to maintain a subcooled state, freezing of the condensed water to turn into ice is suppressed, and the condensed water is likely to be maintained in a liquid state.

With the surface structure of the water-repellent coating, when the condensation water droplets that are in a subcooled state and that have very small diameter combine with each other, energy generated when the water droplets combine with each other may be sufficient to enable the combined water droplets to be removed from the surface of the water-repellent coating. In this case, even if the diameter of the combined water droplet is too large to maintain the subcooled state, it is possible to remove the condensed water droplet, which is combined liquid, from the surface of the water-repellent coating by using energy generated due to the combining.

As described above, the surface of the water-repellent coating can suppress generation of an ice nucleus that becomes a starting point of frost growth and can scatter condensed water before the condensed water freezes on the surface of the heat exchanger. Therefore, it is possible to suppress increase of resistance to airflow due to adherence of frost to the heat exchanger.

In one or more embodiments, a heat exchanger includes a portion on whose surface a water-repellent coating is formed. The surface on which the water-repellent coating is formed has a surface structure that satisfies all of the following relationships:

$$rw(\text{entirety}) > 0.6/|\cos \theta w|,$$

$$rw(\text{protrusion}) > 0.6/|\cos \theta w|,$$

$$0.1 < d/L < 0.8,$$

$$L < 3.0\ \mu\text{m, and}$$

$$90° < \theta w < 120°,$$

where

L is an average pitch of protrusions, d is an average diameter of the protrusions, rw(entirety) is an average area-enlargement ratio of an entire surface, rw(protrusion) is an average area-enlargement ratio of surface protrusions, and θw is a contact angle of water on a flat surface of the water-repellent coating.

Only a part of the surface on which the water-repellent coating is formed may have the surface structure, or the entirety of the surface may have the surface structure. When a part the surface has the surface structure, advantageous effects can be obtained in the part. When the entirety of the surface has the surface structure, advantageous effects can be obtained in the entirety.

The heat exchanger, which has the water-repellent coating, is not likely to hold condensed water and the like, and can easily scatter condensed water. Moreover, because the surface structure is used at a portion where the water-repellent coating is formed, it is possible to scatter condensed water before the condensed water freezes on the surface of the heat exchanger. Therefore, it is possible to suppress increase of resistance to airflow due to adherence of frost to the heat exchanger.

In one or more embodiments, each of the protrusions includes a portion whose cross-sectional area in a plane perpendicular to a protruding direction in which the protrusion protrudes differs in (changes along) the protruding direction.

Here, each of the protrusions may have any of the following shapes: a shape whose cross-sectional area in a plane perpendicular to the protruding direction of the protrusion decreases toward the end of the protrusion in the protruding direction, a shape whose cross-sectional area in a plane perpendicular to the protruding direction of the protrusion increases toward the end of the protrusion in the protruding direction, and a mushroom-like constricted shape whose cross-sectional area in a plane perpendicular to the protruding direction of the protrusion decreases and then increases toward the end of the protrusion in the protruding direction.

Each of the protrusions may have a circular shape or a rectangular shape when seen in the protruding direction of the protrusion.

The heat exchanger can further suppress increase of resistance to airflow due to adherence of frost to the heat exchanger.

In one or more embodiments, each of the protrusions has a shape whose cross-sectional area in a plane perpendicular to a protruding direction in which the protrusion protrudes has at least one minimal value in the protruding direction.

Here, each of the protrusions may have a circular shape or a rectangular shape when seen in the protruding direction of the protrusion.

The heat exchanger can further suppress increase of resistance to airflow due to adherence of frost to the heat exchanger.

In one or more embodiments, the heat exchanger includes a plurality of heat transfer fins and a heat transfer pipe. The heat transfer pipe is fixed to the plurality of heat transfer fins, and refrigerant flows in the heat transfer pipe. A surface of each of the heat transfer fins has the surface structure.

The heat exchanger, in which the surface of each of the heat transfer fins has a specific surface structure, can facilitate processing for realizing the specific surface structure.

An air conditioner according to one or more embodiments includes a refrigerant circuit and a control unit (controller). The refrigerant circuit includes the heat exchanger according to one or more embodiments and a compressor. The control unit causes the refrigerant circuit to perform a normal operation in which the heat exchanger functions as a refrigerant evaporator and a defrosting operation for melting frost adhered to the heat exchanger.

The air conditioner, in which the heat exchanger has a specific surface structure, can suppress adhesion of condensed water and therefore can suppress adhesion of frost. Thus, it is possible to reduce the frequency of defrosting operations and to perform a normal operation for a long time.

An air conditioner according to one or more embodiments includes the heat exchanger according to one or more embodiments and a fan. The fan supplies flow of air to the heat exchanger. The air that is supplied from the fan to the heat exchanger flows in a horizontal direction.

The air conditioner can scatter condensed water from a specific surface structure of the heat exchanger even when flow of air is supplied in a horizontal direction (a direction that is not the direction in which gravity acts on condensed water).

DETAILED DESCRIPTION

Hereinafter, an outdoor heat exchanger 23 and an air conditioner according to one or more embodiments, will be described with reference to the drawings. The embodiments described below are specific examples, do not limit the technological scope of the present invention, and may be appropriately modified within the spirit and scope of the contents of the disclosure.

(1) Air Conditioner 100

Figure 1:
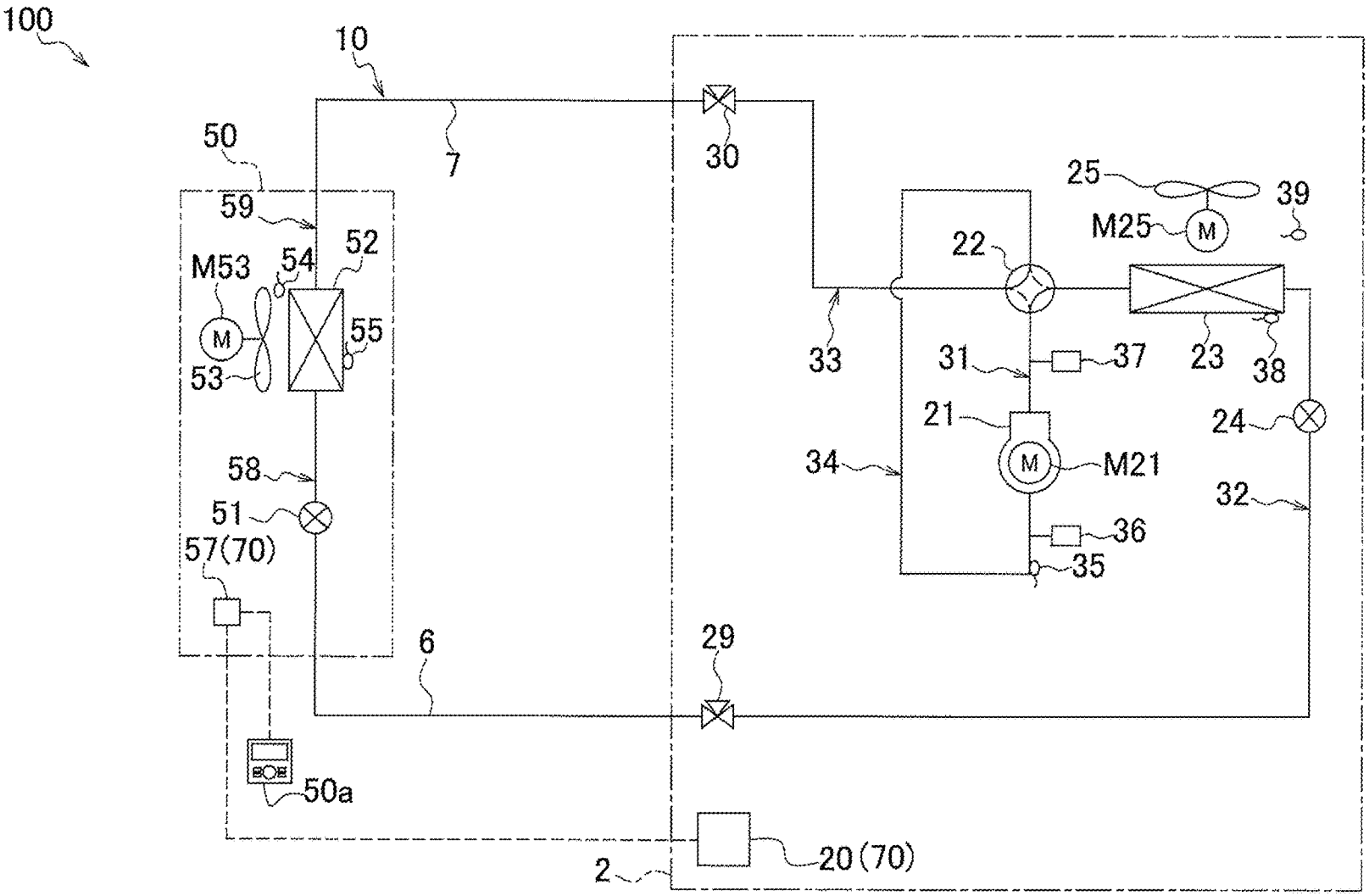
FIG. 1 is a schematic view of an air conditioner including a refrigerant circuit according to one or more embodiments.

FIG. 1 is a schematic view of the air conditioner 100 according to one or more embodiments. The air conditioner 100 is an apparatus that conditions air in a target space by performing a vapor-compression refrigeration cycle.

The air conditioner 100 mainly includes an outdoor unit 2, an indoor unit 50, a liquid-refrigerant connection pipe 6 and a gas-refrigerant connection pipe 7 that connect the outdoor unit 2 and the indoor unit 50, a plurality of remote controllers 50*a* each of which serves as an input device and an output device, and a controller 70 that controls the operation of the air conditioner 100.

The air conditioner 100 performs a refrigeration cycle in which refrigerant, which is sealed in a refrigerant circuit 10, is compressed, cooled or condensed, decompressed, heated or evaporated, and then compressed again. In one or more embodiments, the refrigerant circuit 10 is filled with R32, which is a refrigerant for performing a vapor-compression refrigeration cycle.

(1-1) Outdoor Unit 2

The outdoor unit 2 is connected to the indoor unit 50 via the liquid-refrigerant connection pipe 6 and the gas-refrigerant connection pipe 7, and constitutes a part of the refrigerant circuit 10. The outdoor unit 2 mainly includes a compressor 21, a four-way switching valve 22, the outdoor heat exchanger 23, an outdoor expansion valve 24, an outdoor fan 25, a liquid-side shutoff valve 29, a gas-side shutoff valve 30, and an outdoor casing 2*a*.

The outdoor unit 2 includes a discharge pipe 31, a suction pipe 34, an outdoor gas-side pipe 33, and an outdoor liquid-side pipe 32, which are pipes that constitute the refrigerant circuit 10. The discharge pipe 31 connects the discharge side of the compressor 21 and a first connection port of the four-way switching valve 22. The suction pipe 34 connects the suction side of the compressor 21 and a second connection port of the four-way switching valve 22. The outdoor gas-side pipe 33 connects a third connection port of the four-way switching valve 22 and the gas-side shutoff valve 30. The outdoor liquid-side pipe 32 extends from a fourth connection port of the four-way switching valve 22 to the liquid-side shutoff valve 29 via the outdoor heat exchanger 23 and the outdoor expansion valve 24.

The compressor 21 is a device that compresses low-pressure refrigerant in a refrigeration cycle until the refrigerant has high pressure. Here, as the compressor 21, a hermetically-sealed compressor in which a positive-displacement compression element (not shown), such as a rotary compression element or a scroll compression element, is rotated by a compressor motor M21 is used. The compressor motor M21 is used to change volume, and the operation frequency of the compressor motor M21 can be controlled by using an inverter.

The connection state of the four-way switching valve 22 can be switched between a cooling-operation connection state (and a defrosting operation state) in which the suction side of the compressor 21 and the gas-side shutoff valve 30 are connected while connecting the discharge side of the compressor 21 and the outdoor heat exchanger 23, and a heating-operation connection state in which the suction side of the compressor 21 and the outdoor heat exchanger 23 are connected while connecting the discharge side of the compressor 21 and the gas-side shutoff valve 30.

The outdoor heat exchanger 23 is a heat exchanger that functions as a radiator for high-pressure refrigerant in a refrigeration cycle during a cooling operation and that functions as an evaporator for low-pressure refrigerant in a refrigeration cycle during a heating operation.

The outdoor fan 25 generates airflow for sucking outdoor air into the outdoor unit 2, causing the air to exchange heat with refrigerant in the outdoor heat exchanger 23, and then discharging the air to the outside. The outdoor fan 25 is rotated by an outdoor fan motor M25.

The outdoor expansion valve 24, which is an electric expansion valve whose valve opening degree is controllable, is disposed at a position in the outdoor liquid-side pipe 32 between the outdoor heat exchanger 23 and the liquid-side shutoff valve 29.

The liquid-side shutoff valve 29 is a manual valve that is disposed at a connection portion between the outdoor liquid-side pipe 32 and the liquid-refrigerant connection pipe 6.

The gas-side shutoff valve 30 is a manual valve that is disposed at a connection portion between the outdoor gas-side pipe 33 and the gas-refrigerant connection pipe 7.

Various sensors are disposed in the outdoor unit 2.

To be specific, around the compressor 21 of the outdoor unit 2, a suction temperature sensor 35 for a suction temperature that is the temperature of refrigerant on the suction side of the compressor 21, a suction pressure sensor 36 for detecting a suction pressure that is the pressure of refrigerant on the suction side of the compressor 21, and a discharge pressure sensor 37 for detecting a discharge pressure that is the pressure of refrigerant on the discharge side of the compressor 21, are disposed.

In the outdoor heat exchanger 23, an outdoor heat-exchange temperature sensor 38 for detecting the temperature of refrigerant that flows in the outdoor heat exchanger 23 is disposed.

Around the outdoor heat exchanger 23 or the outdoor fan 25, an outdoor-air temperature sensor 39 for detecting the temperature of outdoor air sucked into the outdoor unit 2 is disposed.

The outdoor unit 2 includes an outdoor-unit controller 20 that controls the operations of components of the outdoor unit 2. The outdoor-unit controller 20 has a microcomputer that includes a CPU, a memory, and the like. The outdoor-unit controller 20 is connected to an indoor-unit controller 57 of each indoor unit 50 via a communication line, and sends and receives control signals and the like. The outdoor-unit controller 20 is electrically connected to each of the suction temperature sensor 35, the suction pressure sensor 36, the discharge pressure sensor 37, the outdoor heat-exchange temperature sensor 38, and the outdoor-air temperature sensor 39; and receives a signal from each of the sensors.

Figure 3:
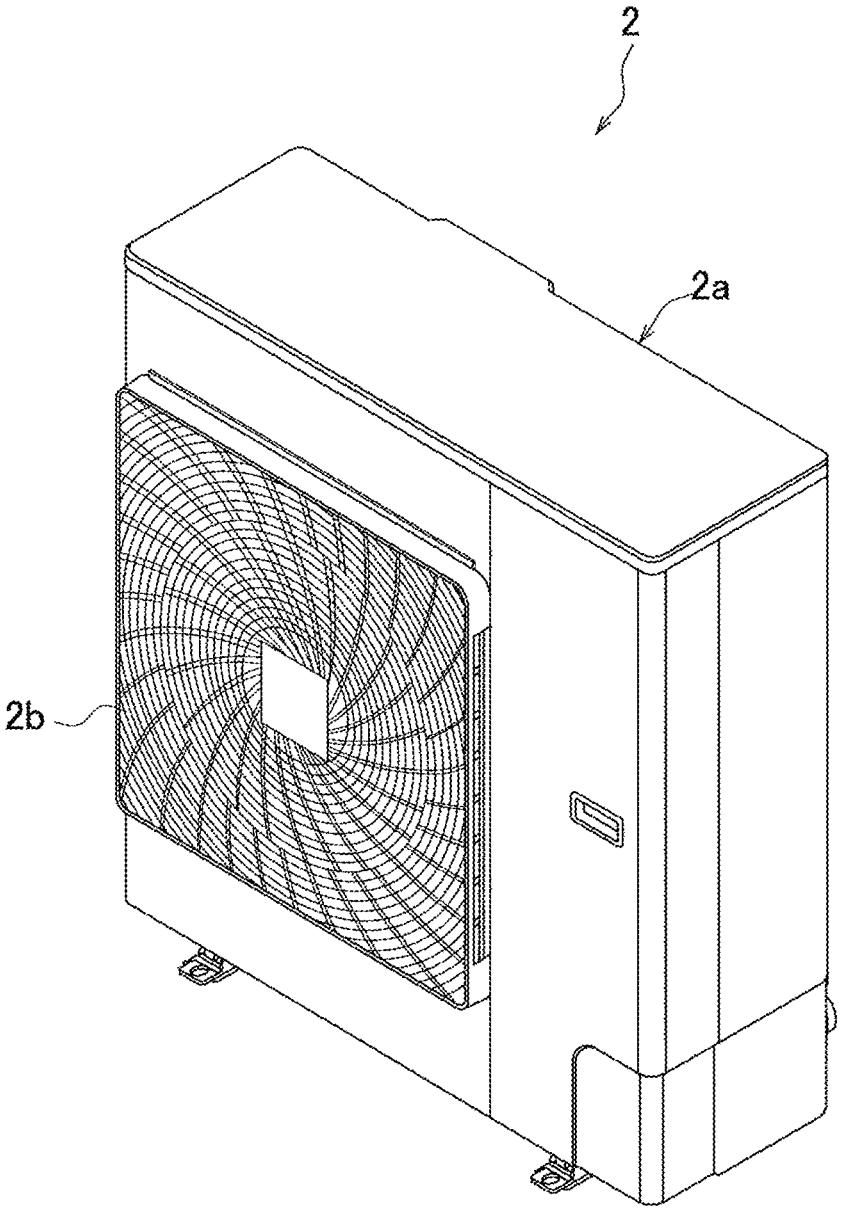
FIG. 3 is an external perspective view of an outdoor unit according to one or more embodiments.
Figure 4:
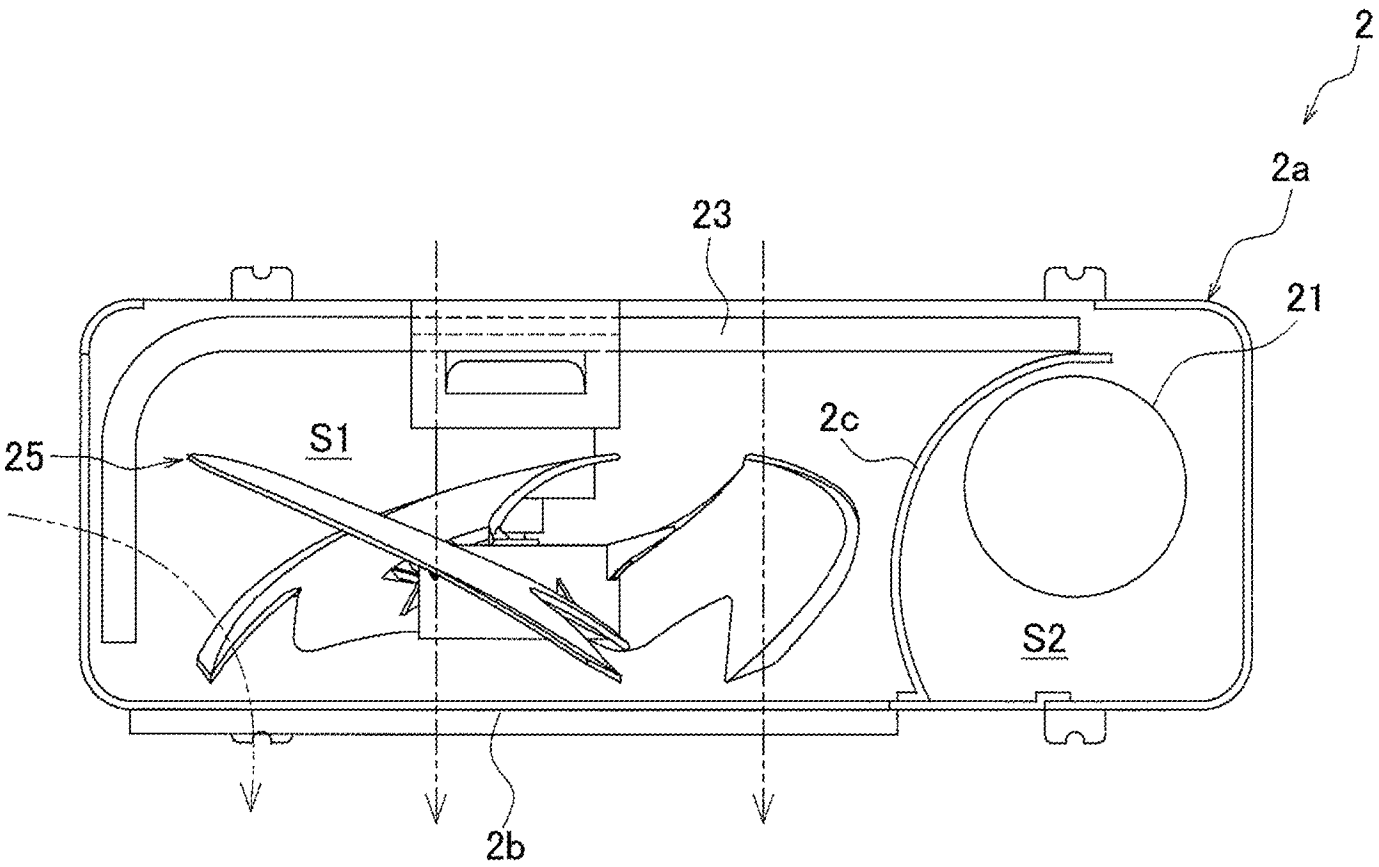
FIG. 4 is a top view of the outdoor unit illustrating the disposition of components according to one or more embodiments.

As illustrated in FIG. 3, which is an external perspective view, and FIG. 4, which is a top view illustrating the disposition of components, the components of the outdoor unit 2 are contained in the outdoor casing 2*a*. The outdoor casing 2*a* is divided by a partition plate 2*c* into a fan chamber S1 and a machine chamber S2. The outdoor heat exchanger 23 is disposed so as to stand in the vertical direction in such a way that a main surface thereof extends in the fan chamber S1 along a back surface of the outdoor casing 2*a* and a side surface of the outdoor casing 2*a* on a side opposite to the machine chamber S2. The outdoor fan 25 is a propeller fan whose rotation-axis direction is the front-back direction. The outdoor fan 25 sucks air in a substantially horizontal direction from the back side of the outdoor casing 2*a* in the fan chamber S1 and the side surface on a side opposite to the machine chamber S2, and generates airflow to the outside forward in a substantially horizontal direction (see two-dot-chain-line arrows in FIG. 4) via a fan grille 2*b* that is disposed on the front side of the fan chamber S1 of the outdoor casing 2*a*. With the structure described above, the airflow generated by the outdoor fan 25 passes so as to be perpendicular to the main surface of the outdoor heat exchanger 23.

(1-2) Indoor Unit 50

The indoor unit 50 is mounted on a wall or a ceiling of a room that is a target space. The indoor unit 50 is connected to the outdoor unit 2 via the liquid-refrigerant connection pipe 6 and the gas-refrigerant connection pipe 7, and constitutes a part of the refrigerant circuit 10.

The indoor unit 50 includes an indoor expansion valve 51, an indoor heat exchanger 52, and an indoor fan 53.

The indoor unit 50 includes an indoor liquid-refrigerant pipe 58 that connects the liquid-side end of the indoor heat exchanger 52 and the liquid-refrigerant connection pipe 6, and an indoor gas-refrigerant pipe 59 that connects the gas-side end of the indoor heat exchanger 52 and the gas-refrigerant connection pipe 7.

The indoor expansion valve 51, which is an electronic expansion valve whose valve opening degree is controllable, is disposed in the indoor liquid-refrigerant pipe 58.

The indoor heat exchanger 52 is a heat exchanger that functions as an evaporator for low-pressure refrigerant in a refrigeration cycle during a cooling operation and that functions as a radiator for high-pressure refrigerant in a refrigeration cycle during a heating operation.

The indoor fan 53 generates airflow for sucking indoor air into the indoor unit 50, causing the air to exchange heat with refrigerant in the indoor heat exchanger 52, and then discharging the air to the outside. The indoor fan 53 is rotated by an indoor fan motor M53.

Various sensors are disposed in the indoor unit 50.

To be specific, in the indoor unit 50, an indoor-air temperature sensor 54 for detecting the temperature of air in a space where the indoor unit 50 is disposed, and an indoor heat-exchange temperature sensor 55 for detecting the temperature of refrigerant that flows in the indoor heat exchanger 52 are disposed.

The indoor unit 50 includes the indoor-unit controller 57 that controls the operations of components the indoor unit 50. The indoor-unit controller 57 has a microcomputer that includes a CPU, a memory, and the like. The indoor-unit controller 57 is connected to the outdoor-unit controller 20 via a communication line, and sends and receives control signals and the like.

The indoor-unit controller 57 is electrically connected to each of the indoor-air temperature sensor 54 and the indoor heat-exchange temperature sensor 55; and receives a signal from each of the sensors.

(1-3) Remote Controller 50*a*

The remote controller 50*a* is an input device with which a user of the indoor unit 50 inputs various instructions for switching the operation states of the air conditioner 100. The remote controller 50*a* also functions as an output device for informing a user of the operation states of the air conditioner 100 and predetermined information. The remote controller 50*a* and the indoor-unit controller 57, which are connected via a communication line, send a signal to and receive a signal from each other.

(2) Details of Controller 70

In the air conditioner 100, the outdoor-unit controller 20 and the indoor-unit controller 57, which are connected via a communication line, constitute the controller 70 for controlling the operation of the air conditioner 100.

Figure 2:
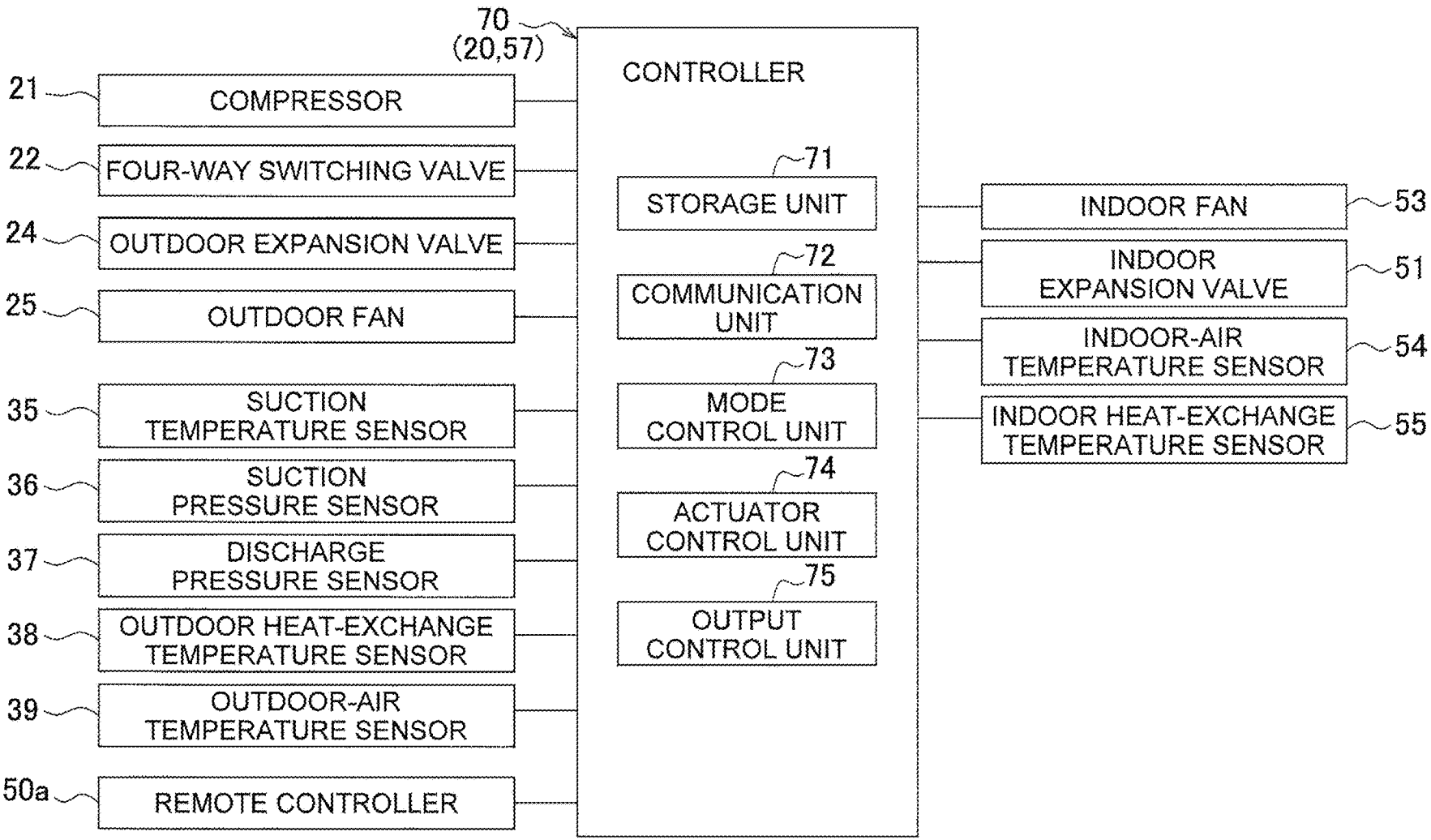
FIG. 2 is a schematic block diagram of the air conditioner according to one or more embodiments.

FIG. 2 is a schematic block diagram illustrating the basic structure of the controller 70 and units that are connected to the controller 70.

The controller 70 has a plurality of control modes and controls the operation of the air conditioner 100 in accordance with the control modes. For example, the controller 70 has, as the control modes, a cooling operation mode, a heating operation mode, and a defrosting operation mode.

The controller 70 is electrically connected to actuators included in the outdoor unit 2 (to be specific, the compressor 21 (the compressor motor M21), the outdoor expansion valve 24, and the outdoor fan 25 (the outdoor fan motor M25)); and various sensors (the suction temperature sensor 35, the suction pressure sensor 36, the discharge pressure sensor 37, the outdoor heat-exchange temperature sensor 38, the outdoor-air temperature sensor 39, and the like). The controller 70 is electrically connected to actuators included in the indoor unit 50 (to be specific, the indoor fan 53 (the indoor fan motor M53) and the indoor expansion valve 51). The controller 70 is electrically connected to the indoor-air temperature sensor 54, the indoor heat-exchange temperature sensor 55, and the remote controller 50*a*.

The controller 70 mainly includes a storage unit 71, a communication unit 72, a mode control unit 73, an actuator control unit 74, and an output control unit 75. These units in the controller 70 are realized because units included in the outdoor-unit controller 20 and/or the indoor-unit controller 57 function integrally.

(2-1) Storage Unit 71

The storage unit 71 is composed of, for example, a ROM, a RAM, a flash memory, and the like; and includes a volatile storage area and a non-volatile storage area. The storage unit 71 stores a control program in which processing to be executed by each unit of the controller 70 is defined. The storage unit 71 stores predetermined information (for example, values detected by sensors, commands input to the remote controller 50*a*, and the like) appropriately in predetermined storage areas via the units of the controller 70.

(2-2) Communication Unit 72

The communication unit 72 is a functional unit that serves as a communication interface for sending a signal to and receiving a signal from each of devices that are connected to the controller 70. The communication unit 72 sends a predetermined signal to a specified actuator upon request from the actuator control unit 74. The communication unit 72 receives a signal output from each of the sensors 35 to 39, 54, and 55, and the remote controller 50*a*, and stores the signal in a predetermined storage area of the storage unit 71.

(2-3) Mode Control Unit 73

The mode control unit 73 is a functional unit that performs switching between control modes and the like. The mode control unit 73 switches among the cooling operation mode, the heating operation mode, and the defrosting operation mode in accordance with an input from the remote controller 50*a* and operating conditions.

(2-4) Actuator Control Unit 74

The actuator control unit 74 controls the operations of the actuators (for example, the compressor 21 and the like) included in the air conditioner 100 in accordance with the control program and conditions.

For example, the actuator control unit 74 controls, in real time, the rotation speed of the compressor 21, the rotation speeds of the outdoor fan 25 and the indoor fan 53, the opening degree of the outdoor expansion valve 24, the opening degree of the indoor expansion valve 51, and the like in accordance with a set temperature, values detected by various sensors, and the like.

(2-5) Output Control Unit 75

The output control unit 75 is a functional unit that controls the operation of the remote controller 50*a* as a display device.

The output control unit 75 causes the remote controller 50*a* to output predetermined information in order to display information about the operation state and conditions to a user.

(3) Various Operation Modes

Hereinafter, flow of refrigerant during a cooling operation mode, a heating operation mode, and a defrosting operation mode will be described.

(3-1) Cooling Operation Mode

In the air conditioner 100, in the cooling operation mode, the connection state of the four-way switching valve 22 is switched to a cooling-operation connection state in which the suction side of the compressor 21 and the gas-side shutoff valve 30 are connected while connecting the discharge side of the compressor 21 and the outdoor heat exchanger 23. Refrigerant that fills the refrigerant circuit 10 is circulated mainly in order of the compressor 21, the outdoor heat exchanger 23, the outdoor expansion valve 24, the indoor expansion valve 51, and the indoor heat exchanger 52.

To be more specific, when the cooling operation mode is started, in the refrigerant circuit 10, the refrigerant is sucked into the compressor 21, compressed, and then discharged.

The gas refrigerant discharged from the compressor 21 passes through the discharge pipe 31 and the four-way switching valve 22, and flows into the gas-side end of the outdoor heat exchanger 23.

The gas refrigerant flowed into the gas-side end of the outdoor heat exchanger 23 releases heat and condenses by exchanging heat with outdoor air that is supplied by the outdoor fan 25 in the outdoor heat exchanger 23. Thus, the gas refrigerant becomes liquid refrigerant and flows out from the liquid-side end of the outdoor heat exchanger 23.

The liquid refrigerant flowed out from the liquid-side end of the outdoor heat exchanger 23 passes through the outdoor liquid-side pipe 32, the outdoor expansion valve 24, the liquid-side shutoff valve 29, and the liquid-refrigerant connection pipe 6; and flows into the indoor unit 50. In the cooling operation mode, the outdoor expansion valve 24 is controlled to be fully open.

The refrigerant flowed into the indoor unit 50 passes through a part of the indoor liquid-refrigerant pipe 58, and flows into the indoor expansion valve 51. The refrigerant flowed into the indoor expansion valve 51 is decompressed by the indoor expansion valve 51 until the refrigerant has low pressure in a refrigeration cycle, and then flows into the liquid-side end of the indoor heat exchanger 52. In the cooling operation mode, the opening degree of the indoor expansion valve 51 is controlled so that the degree of superheating of refrigerant sucked into the compressor 21 becomes a predetermined degree of superheating. Here, the degree of superheating of refrigerant sucked into the compressor 21 is calculated by the controller 70 by using a temperature detected by the suction temperature sensor 35 and a pressure detected by the suction pressure sensor 36. The refrigerant flowed into the liquid-side end of the indoor heat exchanger 52 evaporates by exchanging heat with indoor air supplied by the indoor fan 53 and becomes gas refrigerant in the indoor heat exchanger 52; and flows out from the gas-side end of the indoor heat exchanger 52. The gas refrigerant flowed out from the gas-side end of the indoor heat exchanger 52 flows to the gas-refrigerant connection pipe 7 via the indoor gas-refrigerant pipe 59.

In this way, refrigerant that flows in the gas-refrigerant connection pipe 7 passes through the gas-side shutoff valve 30, the outdoor gas-side pipe 33, the four-way switching valve 22, and the suction pipe 34; and is sucked into the compressor 21 again.

(3-2) Heating Operation Mode

In the air conditioner 100, in the heating operation mode, the connection state of the four-way switching valve 22 is switched to a heating-operation connection state in which the suction side of the compressor 21 and the outdoor heat exchanger 23 are connected while connecting the discharge side of the compressor 21 and the gas-side shutoff valve 30. Refrigerant that fills the refrigerant circuit 10 is circulated mainly in order of the compressor 21, the indoor heat exchanger 52, the indoor expansion valve 51, the outdoor expansion valve 24, and the outdoor heat exchanger 23.

To be more specific, when the heating operation mode is started, in the refrigerant circuit 10, the refrigerant is sucked into the compressor 21, compressed, and then discharged.

The gas refrigerant discharged from the compressor 21 flows through the discharge pipe 31, the four-way switching valve 22, the outdoor gas-side pipe 33, and the gas-refrigerant connection pipe 7; and then flows into the indoor unit 50 via the indoor gas-refrigerant pipe 59.

The refrigerant flowed into the indoor unit 50 passes through the indoor gas-refrigerant pipe 59, and flows into the gas-side end of the indoor heat exchanger 52. The refrigerant flowed into the gas-side end of the indoor heat exchanger 52 releases heat and condenses by exchanging heat with indoor air supplied by the indoor fan 53 and becomes liquid refrigerant in the indoor heat exchanger 52; and flows out from the liquid-side end of the indoor heat exchanger 52. The refrigerant flowed out from the liquid-side end of the indoor heat exchanger 52 flows to the liquid-refrigerant connection pipe 6 via the indoor liquid-refrigerant pipe 58 and the indoor expansion valve 51. In the heating operation mode, the opening degree of the indoor expansion valve 51 is controlled to be fully open.

In this way, refrigerant that flows in the liquid-refrigerant connection pipe 6 flows into the outdoor expansion valve 24 via the liquid-side shutoff valve 29 and the outdoor liquid-side pipe 32.

The refrigerant flowed into the outdoor expansion valve 24 is decompressed until the refrigerant has low pressure in a refrigeration cycle, and then flows into the liquid-side end of the outdoor heat exchanger 23. In the heating operation mode, the opening degree of the outdoor expansion valve 24 is controlled so that the degree of superheating of refrigerant sucked into the compressor 21 becomes a predetermined degree of superheating.

The refrigerant flowed into the liquid-side end of the outdoor heat exchanger 23 evaporates by exchanging heat with outdoor air supplied by the outdoor fan 25 and becomes gas refrigerant in the outdoor heat exchanger 23; and flows out from the gas-side end of the outdoor heat exchanger 23.

The refrigerant flowed out from the gas-side end of the outdoor heat exchanger 23 passes through the four-way switching valve 22 and the suction pipe 34; and is sucked into the compressor 21 again.

(3-3) Defrosting Operation Mode

If a predetermined frosting condition is satisfied when the heating operation mode is performed as described above, the heating operation mode is temporarily stopped, and a defrosting operation mode for melting frost adhered to the outdoor heat exchanger 23 is performed.

The predetermined frosting condition, which is not limited, may be, for example, a condition such that a state in which a temperature detected by the outdoor-air temperature sensor 39 and a temperature detected by the outdoor heat-exchange temperature sensor 38 satisfy predetermined temperature conditions continues for a predetermined time or longer.

In the defrosting operation mode, the connection state of the four-way switching valve 22 is switched to the same connection state as in the cooling operation, and the compressor 21 is driven in a state in which the indoor fan 53 is stopped. After starting the defrosting operation mode, if a predetermined defrosting finishing condition is satisfied (for example, if a predetermined time elapses after the defrosting operation mode is started), the connection state of the four-way switching valve 22 is returned to the connection state in the heating operation again, and the heating operation mode is restarted.

(4) Structure of Outdoor Heat Exchanger 23

Figure 5:
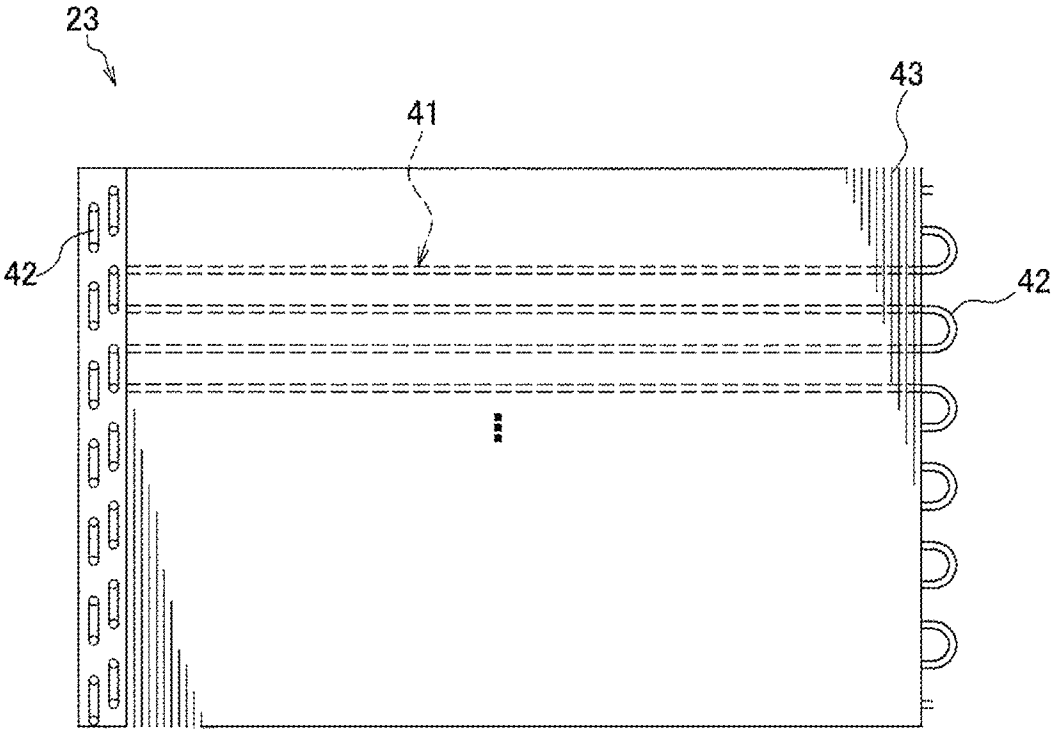
FIG. 5 is a schematic front view of an outdoor heat exchanger according to one or more embodiments.

As illustrated in FIG. 5, which is a schematic front view of the outdoor heat exchanger 23, the outdoor heat exchanger 23 includes a plurality of heat transfer pipes 41 that extend in the horizontal direction, a plurality of U-shaped pipes 42 that connect end portions of the heat transfer pipes 41 to each other, and a plurality of fins 43 that extend in the vertical direction and the airflow direction.

Figure 6:
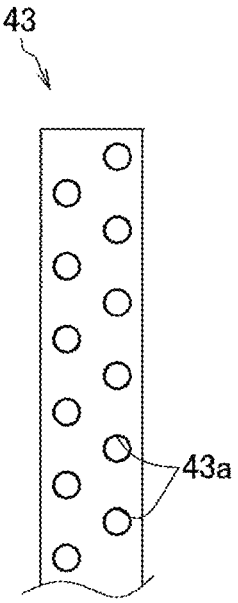
FIG. 6 is a schematic external view of a fin when seen in a direction normal to a main surface of the fin according to one or more embodiments.

The heat transfer pipes 41 are made of copper, a copper alloy, aluminum, an aluminum alloy, and the like. As illustrated in FIG. 6, which is a schematic external view of one of the fins 43 when seen in a direction normal to a main surface of the fin 43, the fin 43 is fixed in such a way that the heat transfer pipes 41 extend through insertion openings 43*a* of the fin 43 and used. The U-shaped pipes 42 are connected to end portions of the heat transfer pipes 41 so that refrigerant can flow in the heat transfer pipes 41 alternately in opposite directions.

(5) Structure of Fin 43

Figure 7:
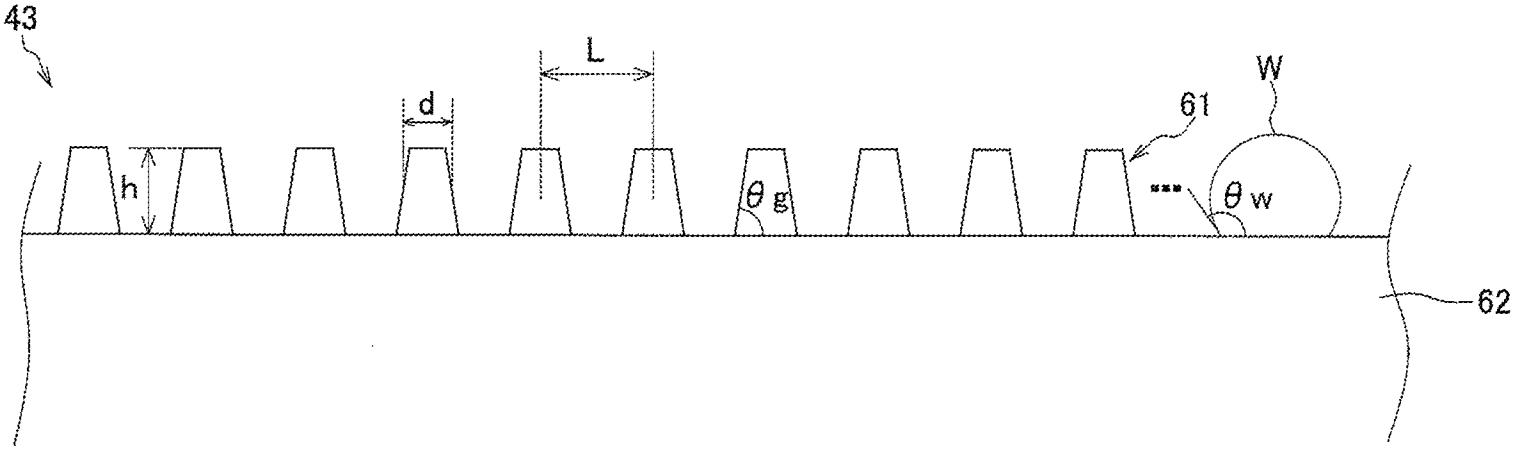
FIG. 7 is a schematic sectional view of a region near a surface of a fin in a case where protrusions each have a conical-frustum shape according to one or more embodiments.
Figure 8:
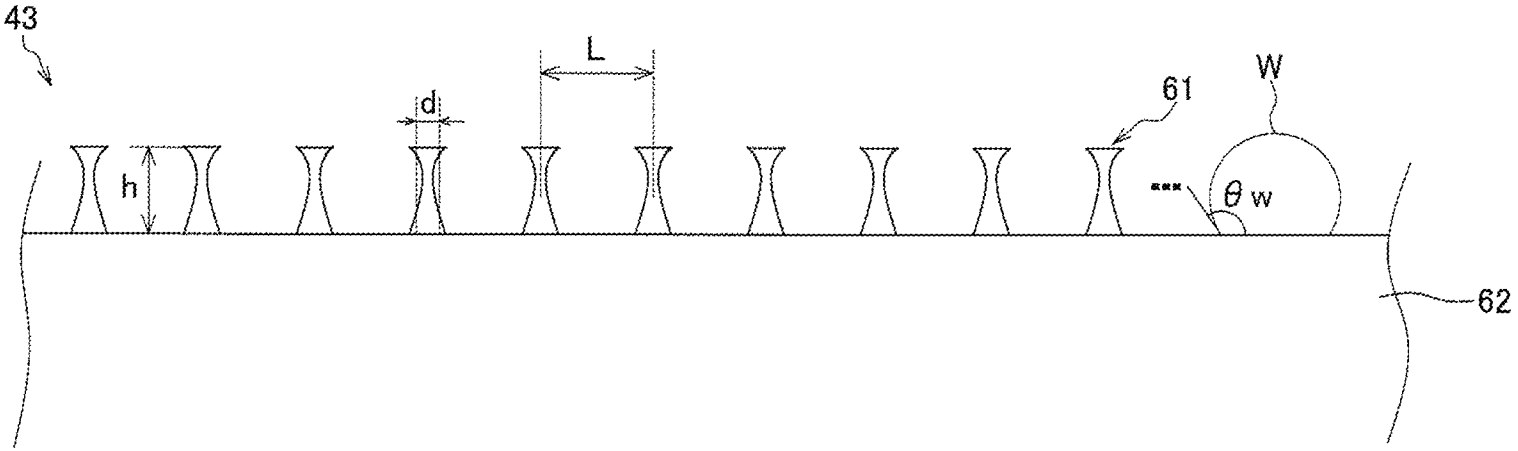
FIG. 8 is a schematic sectional view of a region near a surface of a fin in a case where protrusions each have a constricted shape according to one or more embodiments.
Figure 9:
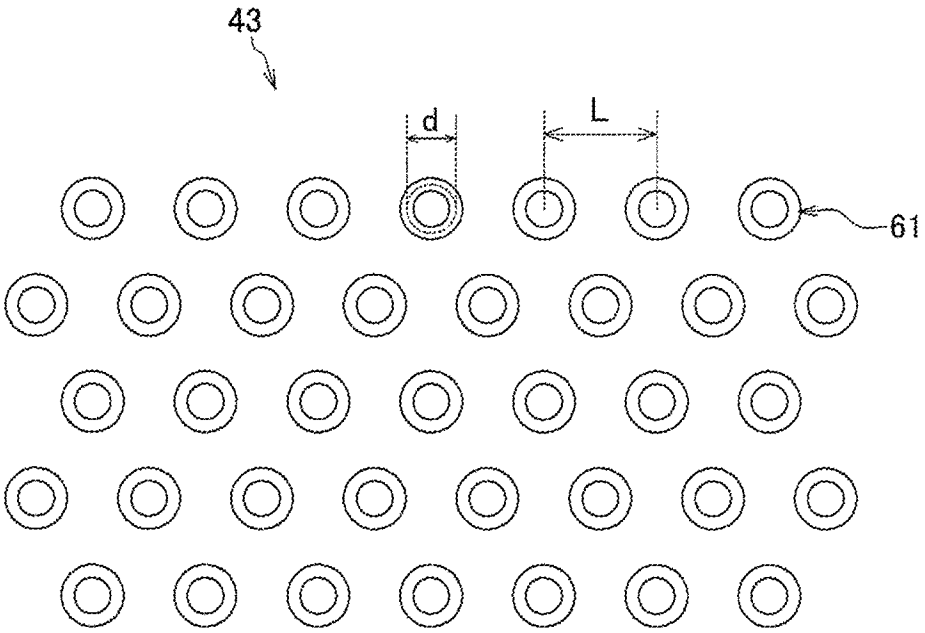
FIG. 9 is a schematic view of a fin when seen in a thickness direction according to one or more embodiments.

The fin 43 includes a substrate 62 and protrusions 61 disposed on a surface of the substrate 62, as illustrated in the following figures: FIG. 7, which is a schematic sectional view of a region near the surface of the fin 43 in a case where the protrusions 61 each have a conical-frustum shape; FIG. 8, which is a schematic sectional view of a region near the surface of the fin 43 in a case where the protrusions 61 each have a constricted shape; and FIG. 9, which is a schematic view of the fin 43 when seen in the thickness direction of the fin 43. The protrusions 61 and the substrate 62 each have a water-repellent coating at a surface layer thereof.

(5-1) Substrate 62

In one or more embodiments, the substrate 62 may be a plate-shaped member that has a thickness of 70 μm or larger and 200 μm or smaller, or 90 μm or larger and 110 μm or smaller. Examples of the material of the substrate 62 include aluminum, an aluminum alloy, and silicon. The surface of a part of the substrate 62 on which the protrusions 61 are not formed is constituted by a water-repellent coating.

(5-2) Protrusion 61

The protrusions 61 are formed on both surfaces of the substrate 62. The structure of each of the protrusions 61, which is not limited, may be a structure such that aluminum, an aluminum alloy, silicon, or the like is covered with a water-repellent coating.

The protrusions 61 are formed so as to satisfy $L<3.0$ μm, where L is the average pitch of the protrusions. In one or more embodiments, in order to enable a water droplet to easily jump from the surface, the average pitch may be $L<1.8$ μm or $L<0.3$ μm. Although not limited, the lower limit of the average pitch L is, for example, 0.01 μm. In one or more embodiments, when an area of 10 μm×10 μm is observed, regarding a plurality of pitches between the protrusions, 80% or more of the pitches may satisfy the conditions on the pitch L described above, or 90% or more of the pitches may satisfy the conditions on the pitch L.

Here, the term "average pitch" refers to the average value of the distances between the centers of cross sections at the central height of the protrusions 61 that satisfy $rw(\text{protrusion})>0.6/|\cos\theta w|$ (protrusions smaller than this are excluded) when an observation area of 10 μm×10 μm of any surface of the fin 43 is observed (rw(protrusion) will be described below).

The observation area is 10 μm×10 μm, because the diameter of a droplet whose autonomous jump is observed is about 120 μm, and, when a droplet having the diameter of 120 μm is present on a surface of a solid with a contact angle of 175°, the solid and the droplet are in contact with each other in an area having a diameter of 10 μm.

The protrusions 61 are formed so that the value of "average diameter d/average pitch L" satisfies $0.1<d/L<0.8$, where d is the average diameter of the protrusions 61.

Here, if d/L is 0.1 or less, the density of the protrusions 61 on the surface of the fin 43 is low, a water droplet tends to enter a space between the protrusions 61, a bubble cannot be included in a lower part of the space between the protrusions 61, a water droplet enters a bottom part of the space between the protrusions 61 (the surface of the substrate 62), and adhesion of the droplet increases. When a water droplet contacts the bottom surface of a recess between the protrusions 61 (the substrate 62) and the area of contact between the water droplet and the fin 43 increases, the droplet receives an increased restraining force from the solid surface when the droplet jumps. Therefore, in one or more embodiments, in order to keep the restraining force small, $0.16<d/L$ or $0.20<d/L$ may be satisfied.

If d/L is 0.8 or larger, although a bubble can be reliably formed in a lower part of the space between the protrusions 61, because the distance between the protrusions 61 is small and the interval of a portion where a water droplet is held is small, a capillary force acts on the water droplet and the water droplet is strongly held by the fin 43. When the area of contact between a water droplet and the end portion of the protrusion 61 increases and thereby the area of contact between the water droplet and the fin 43 increases, the droplet receives an increased restraining force from the solid surface when the liquid force jumps. Therefore, in one or more embodiments, in order to keep the restraining force small, $d/L<0.5$ or $d/L<0.36$ may be satisfied.

Here, the term "average diameter d of the protrusions" refers to, regarding a shape other than a shape whose cross-sectional area in a plane perpendicular to the protruding direction has a minimal value in the protruding direction, the average value of the diameters of circles having circumferences corresponding to the lengths of profiles of cross sections at the central height of the protrusions 61 that satisfy $rw(\text{protrusion})>0.6/|\cos\theta w|$ (protrusions smaller than this are excluded), when an observation area of 10 μm×10 μm of any surface of the fin 43 is observed (rw(protrusion) will be described below). In a case where the protrusions each have a shape whose cross-sectional area in a plane perpendicular to the protruding direction has a minimal value in the protruding direction (for example, a constricted shape), the term "average diameter d of the protrusions" refers to, for the protrusions 61 that satisfy $rw(\text{protrusion})>0.6/|\cos\theta w|$ (protrusions smaller than this are excluded) when an observation area of 10 μm×10 μm of any surface of the fin 43 is observed, the average value of the diameters of circles having areas corresponding to areas that are obtained by dividing the volumes of the protrusions 61 by the protruding heights of the protrusions 61.

The shape of the protrusion 61 is not limited. Examples of the shape include a conical frustum illustrated in FIG. 7 (a shape obtained by cutting a cone along a plane parallel to the bottom surface and removing a small conical part); a frustum such as a pyramidal frustum; a conic solid such as a cone, a pyramid, or a quadrangular pyramid; a columnar body such as a cylinder, a prism, a quadrangular prism, or the like (a tubular body that has a bottom surface and a top surface that are two flat surfaces that are congruent); and a constricted shape illustrated in FIG. 8 (a shape whose cross-sectional area in a plane perpendicular to the protruding direction of the protrusion 61 has a minimal value in the protruding direction, such as a cylinder from which a part of a side surface is removed, a prism from which a part of a side surface is removed, and a conical frustum from which a part of a side surface is removed). In particular, in one or more embodiments, in order to enable a water droplet to easily jump from the surface, the shape of the protrusion 61 may be a shape whose cross-sectional area in a planer perpendicular to the protruding direction of the protrusion 61 varies in the protruding direction, compared with a shape whose cross-sectional area is uniform in the protruding direction. In one or more embodiments, the shape of the protrusion 61 may be a shape whose cross-sectional area decreases toward the end in the protruding direction, a shape whose cross-sectional area has at least one minimal value in the protruding direction, or a mushroom-like shape.

In one or more embodiments where the protrusion 61 is a conical frustum or a conic solid, the protrusion gradient θg (see FIG. 7), which is an inclination angle of the protrusion 61 with respect to the surface of the substrate 62, may be 60° or larger. If the protrusion gradient θg is smaller than 60°, a water droplet tends to behave as if the surface of the fin 43 is a flat surface with no protruding/recessed structure. In one or more embodiments, the upper limit of the protrusion gradient θg, which is not limited, may be 90° or smaller in order to facilitate manufacturing. It is possible to obtain the protrusion gradient θg by obtaining the coordinates of the shape of the protrusion 61 from the results of measurement performed over an observation area of 10 μm×10 μm with the number of measurement points of 256×256 by using an atomic force microscope (hereinafter, abbreviated as AFM) AFM5200S made by Hitachi High-Tech Science Corporation (the same applies hereafter regarding measurement using the AFM), and by calculating the angle between the main surface of an inclined portion of the protrusion 61 and the plane of the substrate 62. To be more specific, it is possible to obtain the protrusion gradient from a section profile by specifying the coordinates of the surface shape from the measurement results obtained by using the AFM.

In one or more embodiments where the protrusion 61 has a shape whose cross-sectional area in a plane perpendicular to the protruding direction has a minimal value in the protruding direction, such as a constricted shape (see FIG. 8), the minimal value may be located nearer than the center to the end in the protruding direction, or may be located at a position within 30% from the end in the protruding direction. Among the cross-sectional areas of the protrusion 61 in a plane perpendicular to the protruding direction, the ratio of the maximum cross-sectional area to the minimal cross-sectional area (large area/small area) may be 1.5 or larger and 4.0 or smaller in one or more embodiments. In one or more embodiments, the ratio of the maximum cross-sectional area to the minimal cross-sectional area (large area/small area) may be 2.0 or larger and 3.0 or smaller. It is possible to specify the cross-sectional area in a plane perpendicular to the protrusion 61, for example, from a cross-sectional profile of the protrusion 61 by obtaining the coordinates of the shape of the protrusion 61 from measurement results obtained by using the AFM.

The average height h of the protrusions 61 is not limited. In one or more embodiments, in view of suppressing increase of the area of contact between a water droplet and the fin 43 due to adhesion of the water droplet to a recess (the substrate 62), the average height h may be 0.5 μm or larger, 0.7 μm or larger, or 1.0 μm or larger. In one or more embodiments, the upper limit of the average height h of the protrusions 61, which is not limited, may be, for example, 8.0 μm, or 7.0 μm.

(5-3) Water-Repellent Coating

The water-repellent coating, which constitutes a surface-layer part of each of the protrusions 61 and the substrate 62, is very thin and does not affect the surface structure of the fin 43 formed by the protrusions 61.

To be specific, in one or more embodiments, the thickness of the water-repellent coating, which constitutes a surface-layer part of each of the protrusions 61 and the substrate 62, may be, for example, 0.3 nm or larger and 20 nm or smaller, or 1 nm or larger and 17 nm or smaller. Such a water-repellent coating can be formed as, for example, a monomolecular film of a water-repellent agent.

For example, the water-repellent coating can be formed by using a method including: applying, to the protrusions 61 and the substrate 62, a water-repellent coating material such that the bonding strength between the protrusions 61 and the substrate 62 and the molecules of the water-repellent coating material is higher than the bonding strength between the molecules of the water-repellent coating material; and then removing surplus water-repellent coating material by performing treatment for cutting only the bonds between the molecules of the water-repellent coating material.

The contact angle θw of water W on a flat surface of a water-repellent coating satisfies $90° < \theta w < 120°$. Thus, it is possible to keep the area of contact between a water droplet and the fin 43 small. In one or more embodiments, $114° < \theta w < 120°$, in order to keep the area of contact between a water droplet and the fin 43 sufficiently small.

In one or more embodiments, the water-repellent coating, which is not limited, may be an organic monomolecular film including at least one of a fluorocarbon resin, silicone, and a hydrocarbon, or an organic monomolecular film including, among these, a fluorocarbon resin. A monomolecular film including a fluorocarbon resin may be selected from known chemical compounds. For example, silane coupling agents having various fluoroalkyl groups or perfluoropolyether groups may be used. Examples of products used for forming a monomolecular film including a fluorocarbon resin include 1H,1H,2H,2H-heptadecafluorodecyltrimethoxysilane (made by Tokyo Chemical Industry Co., Ltd.), and Optool DSX (made by Daikin Industries, Ltd.).

(5-4) Regarding Surface Area of Fin 43

As described above, the fin 43 includes the protrusions 61 and the substrate 62 whose surfaces have water-repellent coatings. The entire surface of the fin 43 satisfies a condition $rw(\text{entirety}) > 0.6/|\cos \theta w|$, when rw(entirety), which is the average area-enlargement ratio of the entire surface of the fin 43 to the projected area of the fin 43 (the surface area of a flat surface on which the protrusions 61 are not formed), is represented as a function of the contact angle θw of water on the flat surface of the water-repellent coating. In this way, because the surface area is enlarged due to the protrusions 61 formed on the surface of the fin 43 compared with a case where the protrusions 61 are not formed on the surface of the fin 43, it is possible to enable a droplet to autonomously jump easily. The function is determined by calculating the surface free energy for each of a state in which an air layer is included in a region surrounded by adjacent protrusions 61 and a droplet and a state in which a space between adjacent protrusions 61 is wetted with a droplet, and by making the former state be lower in surface free energy and be a stable state.

The average area-enlargement ratio of the entire surface rw(entirety) is the average value of the enlargement ratios of the surface area relative to the area of the flat surface (projected area), when an observation area of 10 μm×10 μm of any surface of the fin 43 is observed ten times while changing the observation area. It is possible to obtain the average area-enlargement ratio of the entire surface rw(entirety) by specifying the coordinates of the surface shape from the measurement results obtained by using the AFM.

In one or more embodiments, the average area-enlargement ratio of the entire surface rw(entirety) may satisfy rw(entirety)>1.0/|cos θw|, in order that an air layer can be easily formed below a droplet in a recess between the protrusions 61 and the droplet can autonomously jump more easily.

Regarding a portion of the fin 43 on whose surface the protrusions 61 are formed, the average area-enlargement ratio of surface protrusions rw(protrusion), which is the ratio of the surface area of the protrusions 61 to the projected area of the protrusions 61, satisfies a condition rw(protrusion) >0.6/|cos θw|, when rw(protrusion) is represented as a function of the contact angle θw of water on the flat surface of the water-repellent coating. In this way, because the surface area is enlarged by forming the protrusions 61 on the fin 43 compared with a case where the protrusions 61 are not formed on the surface of the fin 43, it is possible to enable a droplet to autonomously jump easily.

In one or more embodiments, the average area-enlargement ratio of surface protrusions rw(protrusion) may satisfy rw(protrusion)>1.0/|cos θw|, in order that an air layer can be easily formed below a droplet in a recess between the protrusions 61 and the droplet can autonomously jump more easily.

The average area-enlargement ratio of surface protrusions rw(protrusion) is the average value of the enlargement ratios of the protrusions 61 included when any surface of the fin 43 is observed with an observation area of 10 μm×10 μm. It is possible to obtain the average area-enlargement ratio of surface protrusions rw(protrusion) by specifying the coordinates of the surface shape from the measurement results obtained by using the AFM.

(6) Features

With the outdoor heat exchanger 23 according to one or more embodiments, while using a specific microscopic protruding/recessed shape for the surface structure of the fin 43, a water-repellent coating having specific water-repellency is further formed on the surface. Therefore, even when condensed water is generated, when a droplet becomes large, it is possible to cause the droplet to autonomously jump from the fin 43 by releasing surplus surface energy without depending on gravity.

Therefore, even when the outdoor heat exchanger 23 is used in a frosting environment, it is possible to reduce adherence of frost by scattering condensed water and to prolong a heating operation time before a defrosting operation is started. Thus, it is possible to reduce discomfort due to decrease of the temperature of an air-conditioning target space that may occur if the defrosting operation is frequently performed.

The outdoor heat exchanger 23 according to one or more embodiments receives airflow in a horizontal direction from the outdoor fan 25 (does not receive airflow in the vertical direction for promoting dropping of water droplets). Because a specific microscopic structure and a structure having water repellency are used, it is possible to remove water droplets from the surface of the fin 43 even though airflow is supplied only in the horizontal direction. In particular, because the surface structure and water repellency are used, it is possible to cause a water droplet to autonomously jump at a position where airflow is not particularly generated or at a position where airflow is weak, and therefore it is possible to efficiently suppress adherence of frost.

The mechanism by which a droplet can autonomously jump when the droplet becomes large on the surface of the fin 43 by releasing surplus surface energy without depending on gravity is not limited. For example, the mechanism is considered to be as illustrated in FIGS. 10A-10F.

Figures 10A, 10B, 10C, 10D, 10E, 10F:
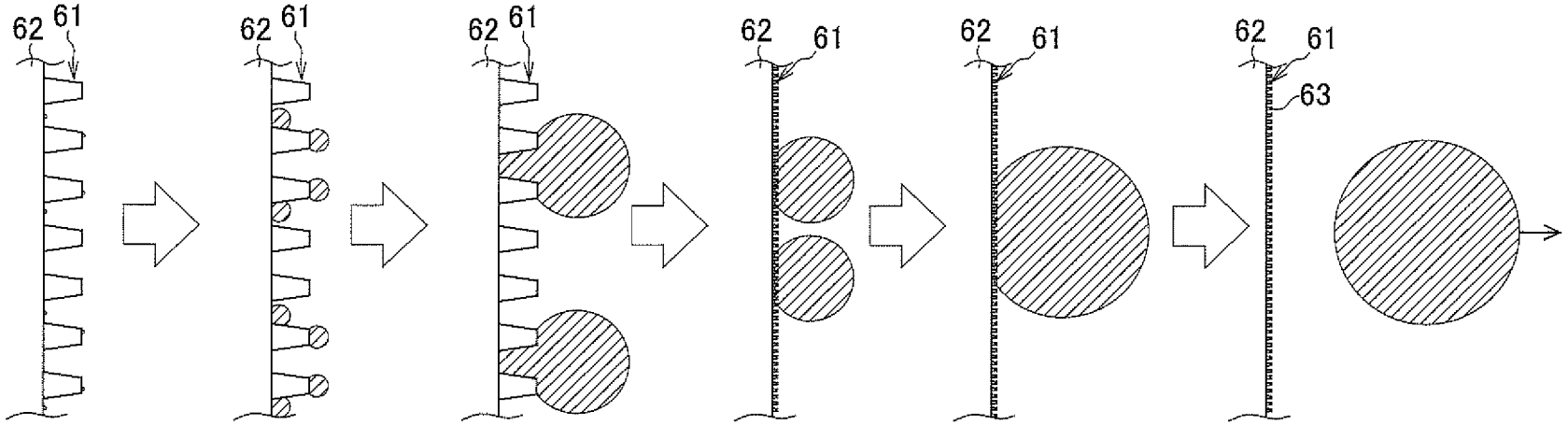
FIGS. 10A-10F illustrate the mechanism of a phenomenon in which a droplet jumps according to one or more embodiments.

First, as illustrated in FIG. 10A, microscopic droplets that serves as nuclei (each having a diameter of about several nanometers) are generated on a surface of the fin 43 of the outdoor heat exchanger 23 that is functioning as a refrigerant evaporator. Next, as illustrated in FIG. 10B, the generated nuclei grow, and the diameters of the condensation droplets increase. Subsequently, as illustrated in FIG. 10C, each of the droplets further grows and enters a state in which the droplet fills a recess between adjacent protrusions 61 of the fins 43 and adheres to the adjacent protrusions 61. Further, as illustrated in FIG. 10D, the droplet grows so as to extend over a plurality of pairs of adjacent protrusions 61. Then, as illustrated in FIG. 10E, adjacent droplets combine with each other. When the droplets combine with each other, surface free energy changes and exceeds a restraining force of the droplets to the surface of the fin 43, and the droplet autonomously jumps as illustrated in FIG. 10F.

Kinetic energy $E_k$ for enabling a droplet to autonomously jump can be represented as follows by mechanical modeling:

$$E_k=0.5mU^2=\Delta E_s-E_w-\Delta E_h-\Delta E_{vis}$$

where m is the mass of the droplet, and U is the speed of the droplet that jumps.

Here, $\Delta E_s$ represents the amount of change in surface free energy when droplets combine with each other, $E_w$ represents restraining energy that the droplet receives from a solid surface, $\Delta E_h$ represents the amount of change in potential energy (which is substantially zero, because the fin 43 according to one or more embodiments extends in the vertical direction), and $\Delta E_{vis}$ represents viscous drag when liquid flows.

In the above relational expression, when droplets are small, surface free energy that is generated when the droplets combine with each other is small, and autonomous jump does not occur. At this stage, because the droplets are small, even when the ambient temperature becomes 0° C. or lower, the droplets do not freeze and are likely to be maintained in a subcooled state. In one or more embodiments, in order to promote autonomous jumping of the droplets, the fin 43 may have a surface structure such that the restraining force of the surface is small. Then, it is considered that autonomous jumping occurs when the surface free energy that is generated when the droplets combine with each other exceeds the restraining force to the surface. Thus, even in a case where it becomes difficult for the droplets to maintain the subcooled state as the size of the droplets increases and it becomes more likely that freezing starts, it is considered that, in this case, the combined droplets jump due to surface free energy that is generated when the droplets combine with each other, the droplets are not likely to remain on the surface, and adherence of frost can be reduced.

In one or more embodiments, because the temperature of a droplet generated on the surface of the fin 43 gradually decreases and starts to freeze, the droplet may be caused to jump before the droplet starts to freeze on the surface of the fin 43. Accordingly, it is necessary to design the surface structure in consideration the growing speed of a condensation droplet. Here, the microscopic surface structure and water-repellent characteristics need to be capable of causing a droplet that has grown before freezing of the droplet starts to autonomously jump, in consideration of the growing speed of a droplet on the surface of the fin 43 of the outdoor heat exchanger 23 under air-conditioning conditions (when the outdoor heat exchanger 23 is used as a refrigerant evaporator). From the above viewpoints, the microscopic surface structure and the water-repellent characteristics of the fin 43 according to one or more embodiments are determined.

(7) Method of Manufacturing Fin 43 of Outdoor Heat Exchanger 23

A method of manufacturing the fin 43 of the outdoor heat exchanger 23 is not limited. For example, a method illustrated in FIGS. 11A-11E may be used.

Figure 11A:
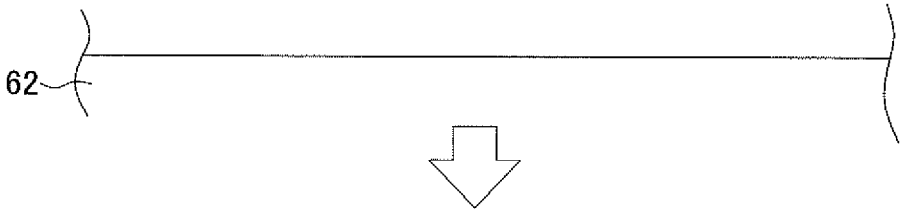
FIGS. 11A-11E illustrate an example of a method of manufacturing a fin according to one or more embodiments.

First, as illustrated in FIG. 11A, the substrate 62 that is a plate-shaped member having a flat surface is prepared. The substrate 62 is made of a metal, such as an aluminum alloy or silicon.

Figure 11B:
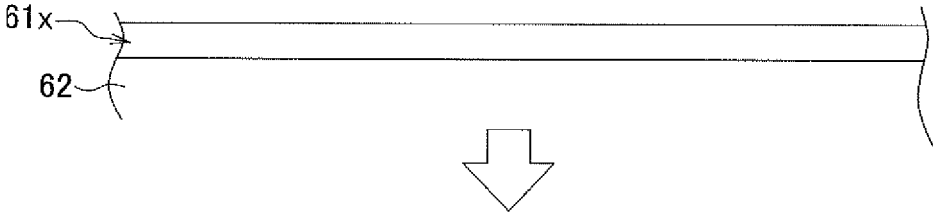

Next, as illustrated in FIG. 11B, a layer having a specific thickness is formed on the surface of the substrate 62. The layer is made of an aluminum alloy, silicon, or the like.

Figure 11C:
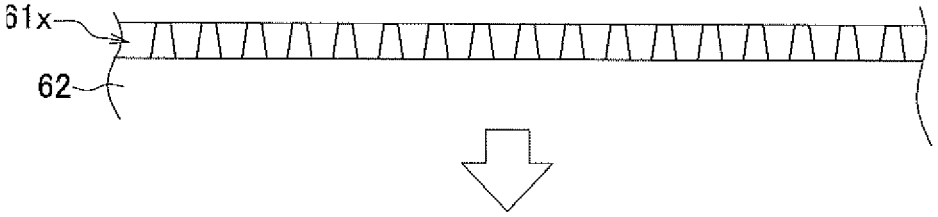

Then, as illustrated in FIG. 11C, the layer formed in FIG. 11B is masked at specific intervals and irradiated with plasma. The average pitch L of the protrusions 61 is controlled by adjusting the interval of masking, and the average diameter d and other shapes of the protrusions 61 are controlled by adjusting the shape of masking. In particular, in a case of forming the protrusions 61 so as to each have a shape whose cross-sectional area in a plane perpendicular to the protruding direction of the protrusion 61 has at least one minimal value in the protruding direction, the shape of the column of the protrusion 61 is controlled by adjusting each of the plasma irradiation amount and the plasma irradiation time.

Figure 11D:
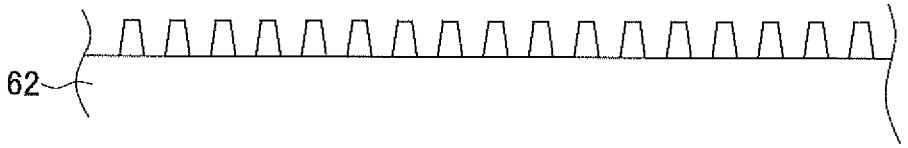

Next, as illustrated in FIG. 11D, etching is performed to form protruding shapes each having a specific shape and having a specific pattern. Here, the protrusion height is controlled by adjusting the etching time.

A method for forming the protruding/recessed shape is not limited to plasma etching. For example, known methods, such as anodic oxidation, boehmite treatment, and almite treatment may be used.

Figure 11E:
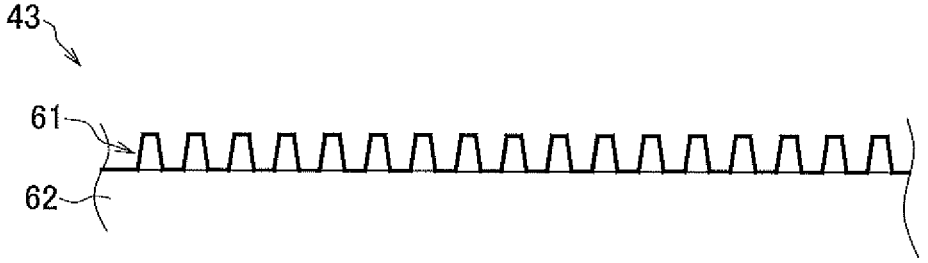

Lastly, as illustrated in FIG. 11E, a water-repellent coating is formed on the protrusions 61 and on the surface of the substrate 62 on which the protrusions 61 are not formed. It is possible to substantially maintain the protruding/recessed shape before applying a water-repellent coating material by selecting a water-repellent coating material, for forming the water-repellent coating, such that the bonding strength between the protrusions 61 and the substrate 62 and the molecules of the water-repellent coating material is higher than the bonding strength between the molecules of the water-repellent coating material, and by washing away surplus water-repellent coating material other than a surface layer after applying the water-repellent coating material.

(8) Modification

The embodiments described above may be modified as shown in the following modification.

(8-1) Modification A

In the embodiments described above, a case where the surface of the fin 43 of the outdoor heat exchanger 23 has a specific microscopic protruding/recessed structure and a water-repellent coating is described as an example.

However, another portion to which condensed water may adhere may also have a specific microscopic protruding/recessed structure and a water-repellent coating. For example, the surface of the heat transfer pipe 41 of the outdoor heat exchanger 23 and the surface of the U-shaped pipe 42 may have the specific microscopic protruding/recessed structure and the water-repellent coating described above. In this case, it is possible to suppress adhesion of condensed water to the portion and to suppress adhesion of frost due to freezing of condensed water.

EXAMPLES

Hereinafter, Examples and Comparative Examples will be described. However, the present invention is not limited to these.

(Example 1)

A plate-shaped member 1 was obtained by using a nano-imprinting mold PIN70-250 made by Soken Chemical & Engineering Co., Ltd., which is a general-purpose item.

A water-repellent coating was applied to the surface of the obtained plate-shaped member 1 as follows.

First, the plate-shaped member 1 was placed in a glass container that was filled with a sufficient amount of acetone in which the entirety of the plate-shaped member 1 could be immersed, and the plate-shaped member 1 was irradiated with ultrasound for 15 minutes in an ultrasonic cleaner. Subsequently, the plate-shaped member 1 was irradiated with UV/ozone for 10 minutes.

The plate-shaped member 1 was immersed in a solution obtained by diluting 1H,1H,2H,2H-heptadecafluorodecyltrimethoxysilane [$CF_3(CF_2)_7CH_2CH_2Si(OCH_3)_3$] to 0.1 wt % with Novec 7200 (made by 3M Company). Then, the plate-shaped member 1 was dried at 150° C. for one hour in a constant-temperature drying oven, and was subsequently dried for one day. The dried plate-shaped member was immersed in Novec 7200 for 5 minutes to remove surplus surface-treatment agent that did not contribute to surface treatment, and Example 1, which was the plate-shaped member 1 having water repellency, was obtained.

(Comparative Example 1)

A plate-shaped member 2 was obtained by using a nano-imprinting mold PIN70-3000 made by Soken Chemical & Engineering Co., Ltd., which is a general-purpose item.

Except that a water-repellent coating was applied to the obtained plate-shaped member 2, Comparative Example 1, which was the plate-shaped member 2 having water repellency was obtained in the same way as in Example 1.

(Contact Angle)

The contact angle of water (static contact angle) was measured by performing five-point measurement on samples of a water droplet having a volume of 2 μl by using a contact angle meter "Drop Master 701". When the contact angle becomes about 150° or larger, depending on the conditions, the liquid becomes unable to be present on the substrate surface by itself. Therefore, in such a case, the contact angle was measured by using a needle of a syringe as a supporter, and the obtained value was used as the contact angle.

(Results)

In Example 1 and in Comparative Example 1, the contact angle of water on a flat surface of the water-repellent coating was 114°.

In Example 1, the average pitch L was 220 to 280 nm, the average diameter d (average diameter) was 115 to 175 nm, the average height h of the protrusions was 220 to 280 nm, d/L was 0.41 to 0.80, the average area-enlargement ratio of the entire surface rw(entirety) was 2.17 to 4.67; and it was possible to observe jumping of a condensed water droplet when used in an outdoor heat exchanger that functions as a refrigerant evaporator.

In Comparative Example 1, the average pitch L was 2700 to 3300 nm, the average diameter d (average diameter) was 1400 to 2000 nm, the average height h of the protrusions was 1200 to 1800 nm, d/L was 0.42 to 0.74, the average area-enlargement ratio of the entire surface rw(entirety) was 1.55 to 2.79; and it was not possible to observe jumping of a condensed water droplet when used in an outdoor heat exchanger that functions as a refrigerant evaporator.

(Examples 2 to 7, Comparative Example 2)

Except for difference in the shape of the protrusions 61, in the same way as in Example 1 and Comparative Example 1, Examples 2 to 7 and Comparative Example 2 were each obtained by applying a water-repellent coating to the surface of the plate-shaped member 1 on which the protrusions 61 each having a specific shape were formed. In Example 4, masking was performed with a pitch different from those of others. In Examples 2 to 4, the average height h was adjusted by adjusting the length of etching time. The shapes of the protrusions 61 in Examples 2 to 7 were formed by adjusting each of the plasma irradiation time and the plasma irradiation amount. Each of the shapes and the dimensions was specified by obtaining the coordinates of the shape of the protrusions 61 from the measurement results obtained by using the AFM and the sectional profile.

In Table 1 shown below, the parenthesized terms represent the shapes of protrusions. Here, the term "Maximum Diameter" refers to the diameter of a circle at a cross section in a plane perpendicular to the protruding direction of the protrusion that is the largest in the protruding direction. In Examples 5 to 7, the maximum diameter refers to the diameter of a circle at the lower end of the protrusion (in Example 7, the diameter of a circle at the upper end and the diameter of a circle at the lower end are the same). The maximum diameter is the average value of the maximum diameters of the protrusions 61 that are obtained from the measurement results measured by using the AFM.

The term "Minimum Diameter" refers to the diameter of a circle at a cross section in a plane perpendicular to the protruding direction of the protrusion that is the smallest in the protruding direction. In Examples 5 and 6, in which the protrusion has a conical frustum shape, the minimum diameter refers to the diameter or a circle at the upper end. In Example 7, in which the protrusion has a mushroom-like shape among constricted shapes, the minimum diameter refers to the diameter of a circle in a portion above the central position in the protruding direction (a portion at about 15% from the upper end in the protruding direction). The minimum diameter is the average value of the minimum diameters of the protrusions 61 that are obtained from the measurement results measured by using the AFM.

The term "Sliding Angle SA" refers to the angle between a surface and a horizontal plane when a droplet placed on the surface starts to slide, and is an indicator of ease for a water droplet in sliding off.

The term "Frost Amount mf" refers to the amount of frost after performing a refrigeration cycle test for a predetermined time that was common to the Examples and Comparative Examples (here, 120 minutes) under frosting conditions. The frost amount mf, whose unit is g, is calculated by measuring the distance between the weights of the sample of the plate-shaped member 1 before and after the test.

The term "Frost Amount Ratio (relative to untreated)" refers to the ratio of the frost amount mf evaluated in each of Examples 2 to 7, when the front amount generated on an untreated surface of Comparative Example 2 was defined as 100%. A smaller value of the frost amount ratio represents that it was possible to suppress adherence of frost by removing droplets.

The unit of each value representing size is nm.

TABLE 1

| | | Example 2 (Cylinder) | Example 3 (Cylinder) | Example 4 (Cylinder) | Example 5 (Conical Frustum) | Example 6 (Conical Frustum) | Example 7 (Constricted) | Comparative Example 2 (untreated) |
|---|---|---|---|---|---|---|---|---|
| Struture | Average Pitch L | 600 | 600 | 1800 | 600 | 600 | 600 | — |
| | Maximum Diameter | 200 | 200 | 600 | 200 | 200 | 200 | — |
| | Minimum Diameter | — | — | — | 120 | 50 | 130 | — |
| | Average Diameter d | 200 | 200 | 600 | 160 | 125 | 165 | — |
| | Average Height h | 2000 | 700 | 6000 | 700 | 700 | 700 | — |
| | Area Enlargement Ratio rw(entirety) | 5.54 | 2.59 | 5.54 | 2.2 | 1.68 | 2.79 | — |
| Wettability | Contact Angle at Flat surface | 114 | 114 | 114 | 114 | 114 | 114 | 114 |
| | Contact Angle CA at Protrusion | 167.8 | 165.2 | 163.1 | 159.1 | 164.2 | 163.9 | — |
| | Sliding Angle SA | 21.3 | 37.3 | 19.7 | >85 | 42.7 | 31.3 | — |
| Results | Frost Amount mf | 0.363 | 0.665 | 0.546 | 0.664 | 0.618 | 0.359 | 1.22 |
| | Frost Amount Ratio (relative to untreated) | 30% | 54% | 45% | 54% | 51% | 29% | 100% |

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

2 outdoor unit
10 refrigerant circuit
20 outdoor-unit controller
21 compressor
23 outdoor heat exchanger
24 outdoor expansion valve
25 outdoor fan
41 heat transfer pipe
42 U-shaped pipe
43 fin
50 indoor unit
51 indoor expansion valve
52 indoor heat exchanger
53 indoor fan
57 indoor-unit controller
61 protrusion
62 substrate
70 controller (control unit)
100 air conditioner

The invention claimed is:

1. A heat exchanger comprising:
a surface with a water-repellent coating, wherein
the surface has a surface structure that includes protrusions,
the surface structure causes condensed water droplets, each having a droplet diameter that allows a subcooled state to be maintained even under a predetermined freezing condition, to combine with one another on the surface and generate energy,
the surface structure uses the energy to remove the combined condensed water droplets from the surface,
each of the protrusions protrudes in a protruding direction,
each of the protrusions has a constricted shape whose cross-sectional area in a plane perpendicular to the protruding direction decreases to a minimum cross-sectional area at a height along the protruding direction that is less than the height of each protrusion and then increases in the protruding direction toward the end of each protrusion,
the height of the minimum cross-sectional area is within 30% from the end of each protrusion in the protruding direction,
the shape of each protrusion has a maximum cross-sectional area in the plane perpendicular to the protruding direction, and
a ratio of the maximum cross-sectional area to the minimum cross-sectional area is greater than or equal to 1.5 and less than or equal to 4.0.

2. The heat exchanger according to claim 1, further comprising:
heat transfer fins; and
a heat transfer pipe that is fixed to the heat transfer fins and in which refrigerant flows, wherein
a surface of each of the heat transfer fins has the surface structure.

3. An air conditioner comprising:
a refrigerant circuit including the heat exchanger according to claim 1;
a compressor; and
a controller that causes the refrigerant circuit to switch between:
a normal operation in which the heat exchanger functions as a refrigerant evaporator, and
a defrosting operation for melting frost adhered to the heat exchanger, wherein
the controller switches from the normal operation to the defrosting operation when a predetermined frosting condition is satisfied during the normal operation.

4. An air conditioner comprising:
the heat exchanger according to claim 1; and
a fan that supplies air to the heat exchanger, wherein
the air flows in a horizontal direction of the heat exchanger.

5. The heat exchanger according to claim 1, wherein
the ratio of the maximum cross-sectional area to the minimum cross-sectional area is greater than or equal to 2.0 and less than or equal to 3.0.

6. A heat exchanger comprising:
a surface with a water-repellent coating, wherein
the surface has a surface structure that includes protrusions,
each of the protrusions protrudes in a protruding direction,
each of the protrusions has a constricted shape whose cross-sectional area in a plane perpendicular to the protruding direction decreases to a minimum cross-sectional area at a height along the protruding direction that is less than the height of each protrusion and then increases in the protruding direction toward the end of each protrusion,
the height of the minimum cross-sectional area is within 30% from the end of each protrusion in the protruding direction,
the shape of each protrusion has a maximum cross-sectional area in the plane perpendicular to the protruding direction, and
a ratio of the maximum cross-sectional area to the minimum cross-sectional area is greater than or equal to 1.5 and less than or equal to 4.0, and
the surface structure satisfies:

$$rw(\text{entirety}) > 0.6/|\cos \theta w|,$$

$$rw(\text{protrusion}) > 0.6/|\cos \theta w|,$$

$$0.1 < d/L < 0.8,$$

$$L < 3.0\ \mu\text{m, and}$$

$$90° < \theta w < 120°, \text{ where}$$

L is an average pitch of the protrusions,
d is an average diameter of the protrusions,
rw(entirety) is an average area-enlargement ratio of an entire surface of a heat transfer fin of the heat exchanger,
rw(protrusion) is an average area-enlargement ratio of a protrusion among the protrusions, and
θw is a contact angle of water on a flat surface of the water-repellent coating.

7. The heat exchanger according to claim 6, further comprising:
heat transfer fins; and
a heat transfer pipe that is fixed to the heat transfer fins and in which refrigerant flows, wherein
a surface of each of the heat transfer fins has the surface structure.

8. An air conditioner comprising:

a refrigerant circuit including the heat exchanger according to claim 6;

a compressor; and a controller that causes the refrigerant circuit to switch between:

a normal operation in which the heat exchanger functions as a refrigerant evaporator, and a defrosting operation for melting frost adhered to the heat exchanger, wherein the controller switches from the normal operation to the defrosting operation when a predetermined frosting condition is satisfied during the normal operation.

9. An air conditioner comprising:

the heat exchanger according to claim 6; and a fan that supplies air to the heat exchanger, wherein the air flows in a horizontal direction of the heat exchanger.

10. The heat exchanger according to claim 6, wherein the ratio of the maximum cross-sectional area to the minimum cross-sectional area is greater than or equal to 2.0 and less than or equal to 3.0.

* * * * *